US005890879A

United States Patent [19]

Rozek

[11] Patent Number: 5,890,879

[45] Date of Patent: Apr. 6, 1999

[54] MOUNTING FOR AIR COMPRESSOR

[75] Inventor: Roy J. Rozek, Plymouth, Wis.

[73] Assignee: Thomas Industries Inc., Sheboygan, Wis.

[21] Appl. No.: 755,751

[22] Filed: Nov. 13, 1996

Related U.S. Application Data

[60] Provisional application No. 60/006,567, Nov. 13, 1995.

[51] Int. Cl. [6] ..... F04B 35/04

[52] U.S. Cl. ..... 417/363; 417/415; 417/423.14

[58] Field of Search ..... 417/363, 415, 417/201, 423.8, 423.14

[56] References Cited

U.S. PATENT DOCUMENTS

| | | | |
|---|---|---|---|
| 2,776,088 | 1/1957 | Wentling | 417/363 |
| 2,896,447 | 7/1959 | Phillips et al. | 73/71 |
| 3,385,542 | 5/1968 | Enemark et al. | 248/20 |
| 3,445,059 | 5/1969 | Hannibal et al. | 230/235 |
| 3,648,999 | 3/1972 | Bauer | 267/160 |
| 3,961,868 | 6/1976 | Droege, Sr. et al. | 417/550 |
| 4,155,529 | 5/1979 | Maudlin | 417/363 |
| 4,842,498 | 6/1989 | Bramstedt et al. | 417/571 |
| 5,062,656 | 11/1991 | Hynds et al. | 280/689 |
| 5,139,242 | 8/1992 | Yarr | 267/160 |
| 5,174,318 | 12/1992 | Dingler et al. | 134/188 |
| 5,213,025 | 5/1993 | Rozek | 92/109 |
| 5,341,871 | 8/1994 | Stelzer | 165/121 |
| 5,482,444 | 1/1996 | Coha et al. | 417/363 |
| 5,509,790 | 4/1996 | Schuderi et al. | 417/415 |

*Primary Examiner*—Charles G. Freay
*Attorney, Agent, or Firm*—Quarles & Brady

[57] ABSTRACT

A motor and reciprocating piston assembly is mounted in housing halves using elastomeric mounting members interposed between the assembly and each half. There are three spaced sleeve-like mounting points on each side of the assembly and three similarly spaced sleeve-like bosses on the housing halves. The mounting members have three mounting portions received in the mounting points and bosses. The three mounting portions are connected by integral arms.

9 Claims, 5 Drawing Sheets

MOUNTING FOR AIR COMPRESSOR

This application claims the benefit of U.S. Provisional Application Ser. No. 60/006,567 filed Nov. 13, 1995.

BACKGROUND OF THE INVENTION

This invention relates to piston pumps and compressors, and more particularly to an improved mounting arrangement for a piston pump or compressor.

Small-scale air compressors are often used to power nebulizers. A typical type of compressor for that purpose uses a wobble piston. Examples of such compressors are found in U.S. Pat. No. 3,961,868, issued Jun. 8, 1976 to Arthur J. Droege, Sr. et al, for "Air Compressor" and U.S. Pat. No. 4,842,498, issued Jun. 27, 1989 to Roy J. Rozek, for "Diaphragm Compressor". As with all piston pumps or compressors, the reciprocating piston creates noise and vibrations that may be undesirable, particularly when in a nebulizer.

SUMMARY OF THE INVENTION

An assembly of a motor and a piston operating in a cylinder is suspended within a housing by means of a pair of resilient mounting elements that connect the assembly to each half of the housing. The mounting elements isolate from the housing vibrations that may result from the operation of the assembly. The isolation of vibratlon is particularly important for tabletop nebulizer units and for those that have an attached jar or other source of liquid to be atomized.

According to the invention, a plurality of spaced mounting points extend outwardly from opposite sides of an assembly of a motor and reciprocating piston, a like plurality of spaced bosses extend inwardly from a pair of housing halves with the bosses alignable with the mounting points on a respective side of the assembly, and resilient mounting members are received in the aligned mounting points and bosses.

Preferably, there are three mounting points and three bosses on each side, and the resilient mounting members have three mounting portions connected by integral arms. The mounting portions are preferably cylindrical extensions that project in both directions from a plane defined by the arms. The extensions are received in the mounting points and bosses which are formed as hollow sleeves. A series of integral projections surround each extension and engage end surfaces of the mounting points and bosses. The mounting members may be formed of an elastomer.

Although the features of the invention are particularly useful for nebulizer compressors, they are also useful for reciprocating pumps and compressors generally.

The foregoing and other objects and advantages of the invention will appear in the detailed description which follows. In the description, reference is made to the accompanying drawings which illustrate a preferred embodiment of the invention.

DETAILED DESCRIPTION OF THE PREFERRED EMBODIMENT

Figure 1:
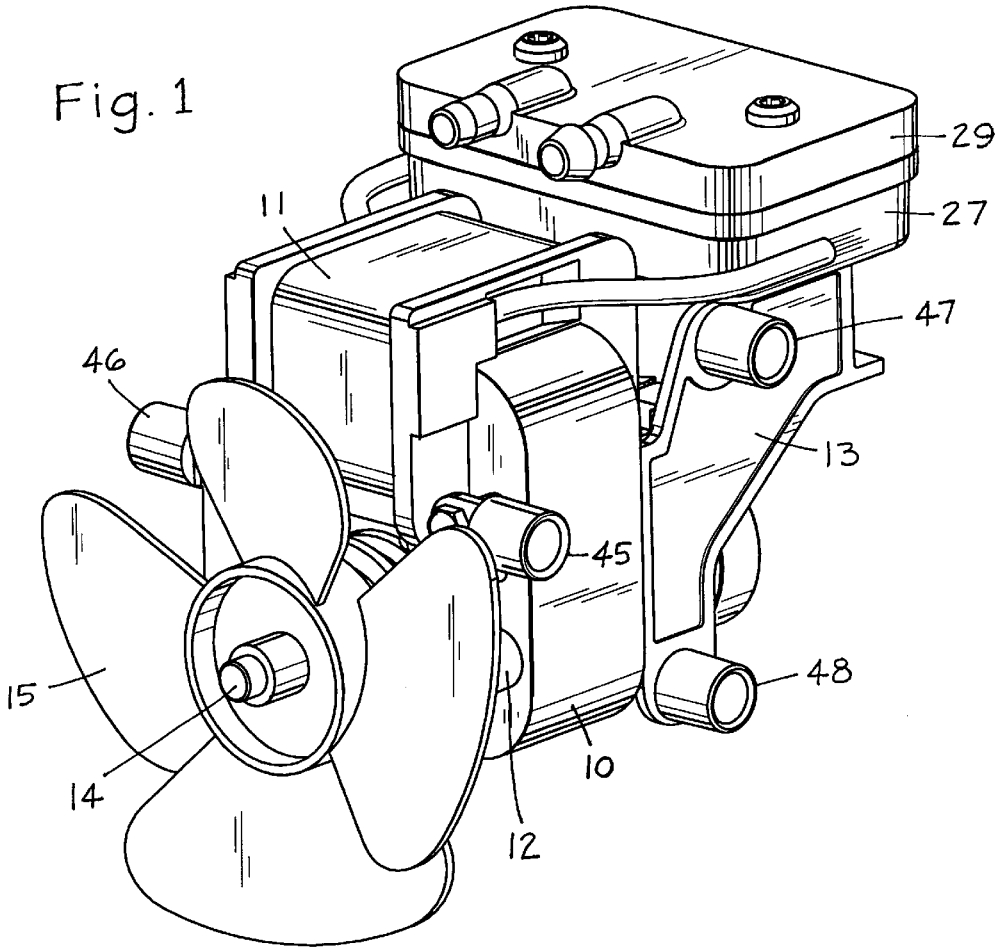
FIG. 1 is a view in perspective viewed from the fan end of a compressor assembly.
Figure 2:
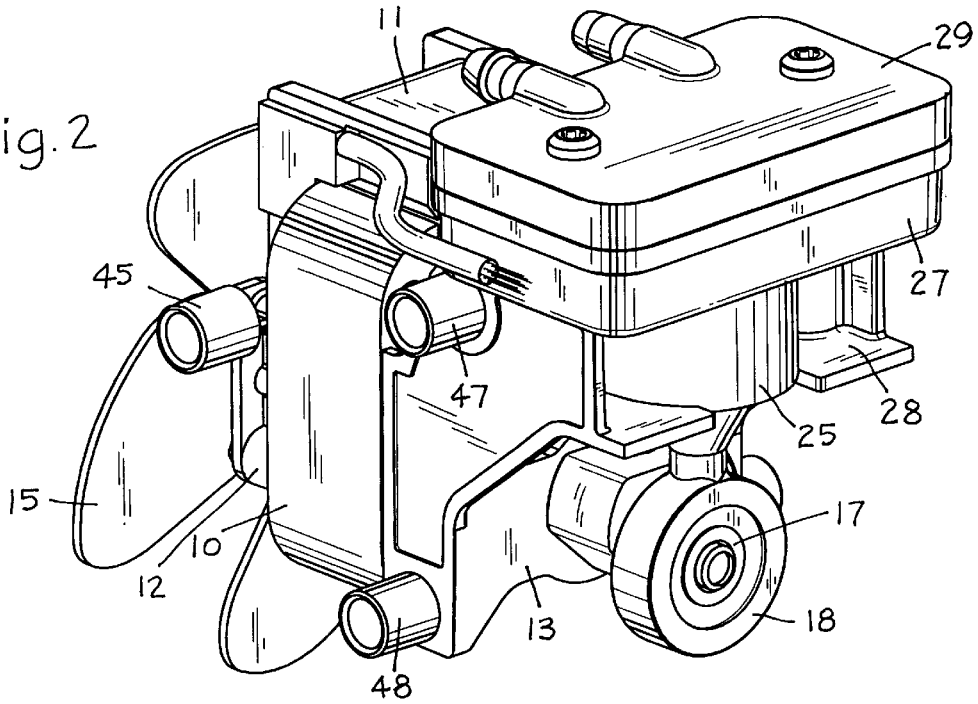
FIG. 2 is a view in perspective viewed from the piston end of the compressor.
Figure 3:
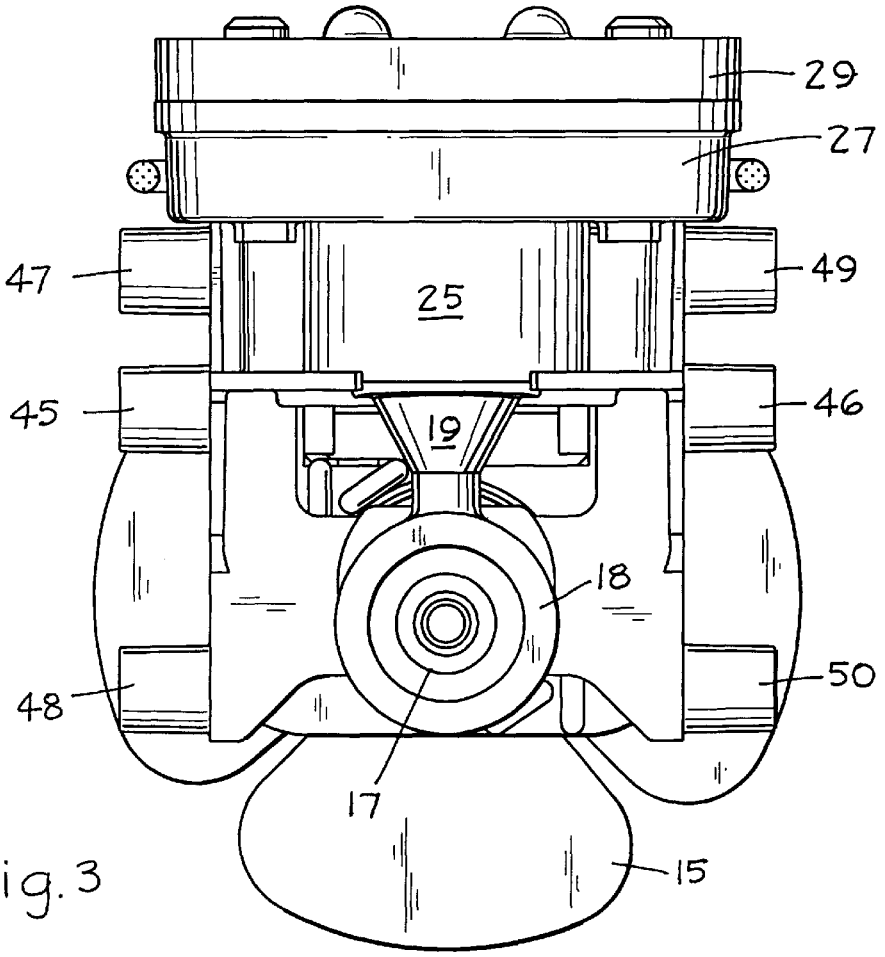
FIG. 3 is a view in elevation of the piston end of the compressor.
Figure 4:
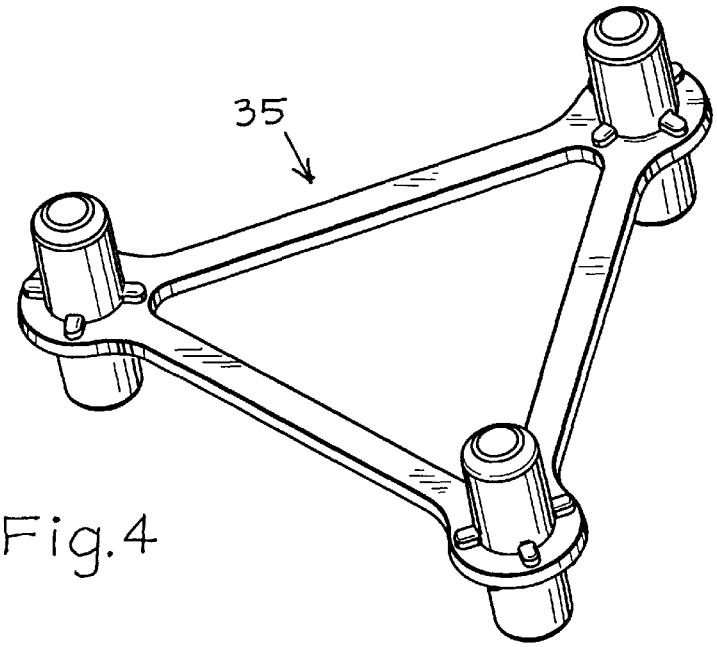
FIG. 4 is a view in perspective of the three-point mounting member.
Figure 5:
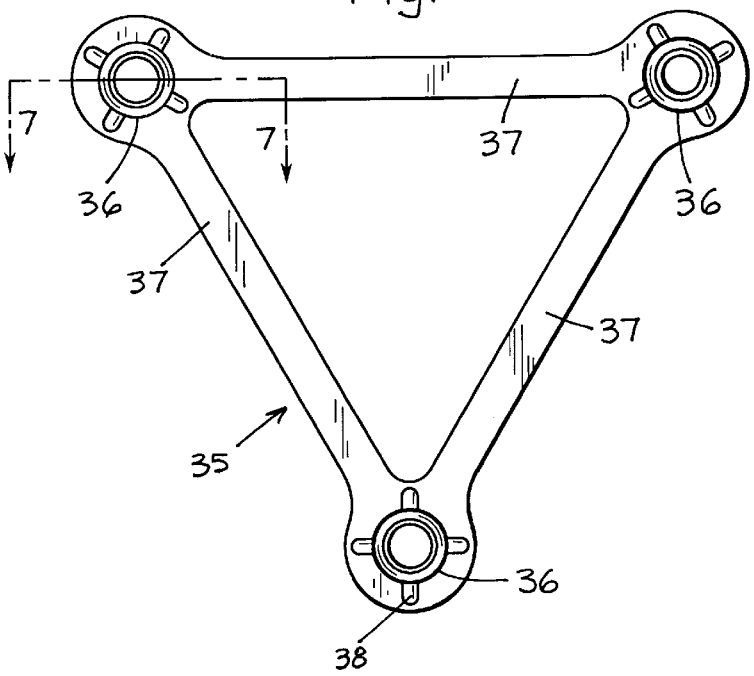
FIG. 5 is a plan view of the three-point mounting member of FIG. 4.

A compressor assembly includes an electric motor having a laminated core 10 surrounded by a coil winding 11. Front and rear brackets 12 and 13, respectively, are attached to each other and to the laminated core 10. The brackets 12 and 13 mount bearings (not shown) that support a motor shaft 14. The motor shaft 14 mounts a fan 15 at one end and an eccentric block 16 at its other end. The eccentric block 16 mounts a bearing 17 that is fitted into a ring 18 on the lower end of a wobble piston 19. The piston 19 operates in a cylinder sleeve 25 having an integral cylinder head with inlet and outlet ports (not shown). The piston may be of the style and form disclosed in U.S. Pat. No. 5,213,025 issued May 25, 1993 to Roy J. Rozek, for "Conical Rod Piston".

A valve head member 27 having inlet and outlet chambers is aligned on the cylinder head of the cylinder sleeve 25. The cylinder sleeve 25 is supported on a recessed ledge 28 in the rear bracket 13. A cover 29 with inlet and outlet fittings is attached to the valve head member 27.

The compressor assembly is intended to be mounted in a housing formed of housing halves 31 and 32. The housing halves 31 and 32 are intended to mate with each other and to be joined by self-threading screws which extend through openings 33 in one housing half 31 and into posts 34 formed in the other housing half 32. The compressor assembly is mounted to the housing halves 31 and 32 in a manner that isolates vibration of the compressor from the housing. This is accomplished through the use of three-point mounting members 35, each having three mounting portions 36 joined together by arms 37 into an equilateral triangle form. The mounting portions could be joined by a circular web instead of the straight arms.

Figure 6:
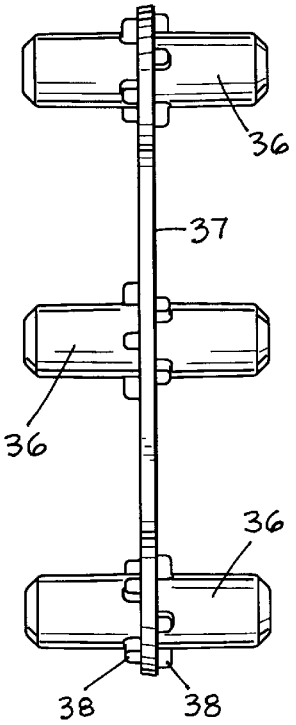
FIG. 6 is a side view of the three-point mounting member of FIGS. 4 and 5.
Figure 8:
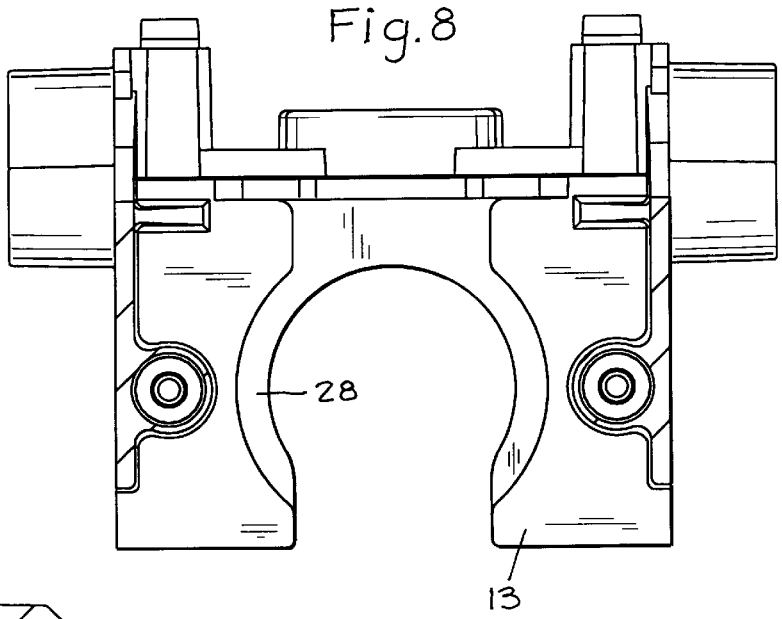
FIG. 8 is a top view of a mounting bracket for the cylinder and valve head of the compressor.
Figure 7:
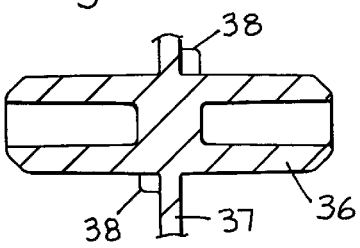
FIG. 7 is a view in section taken in the plane of the line 7—7 of FIG. 5.
Figure 9:
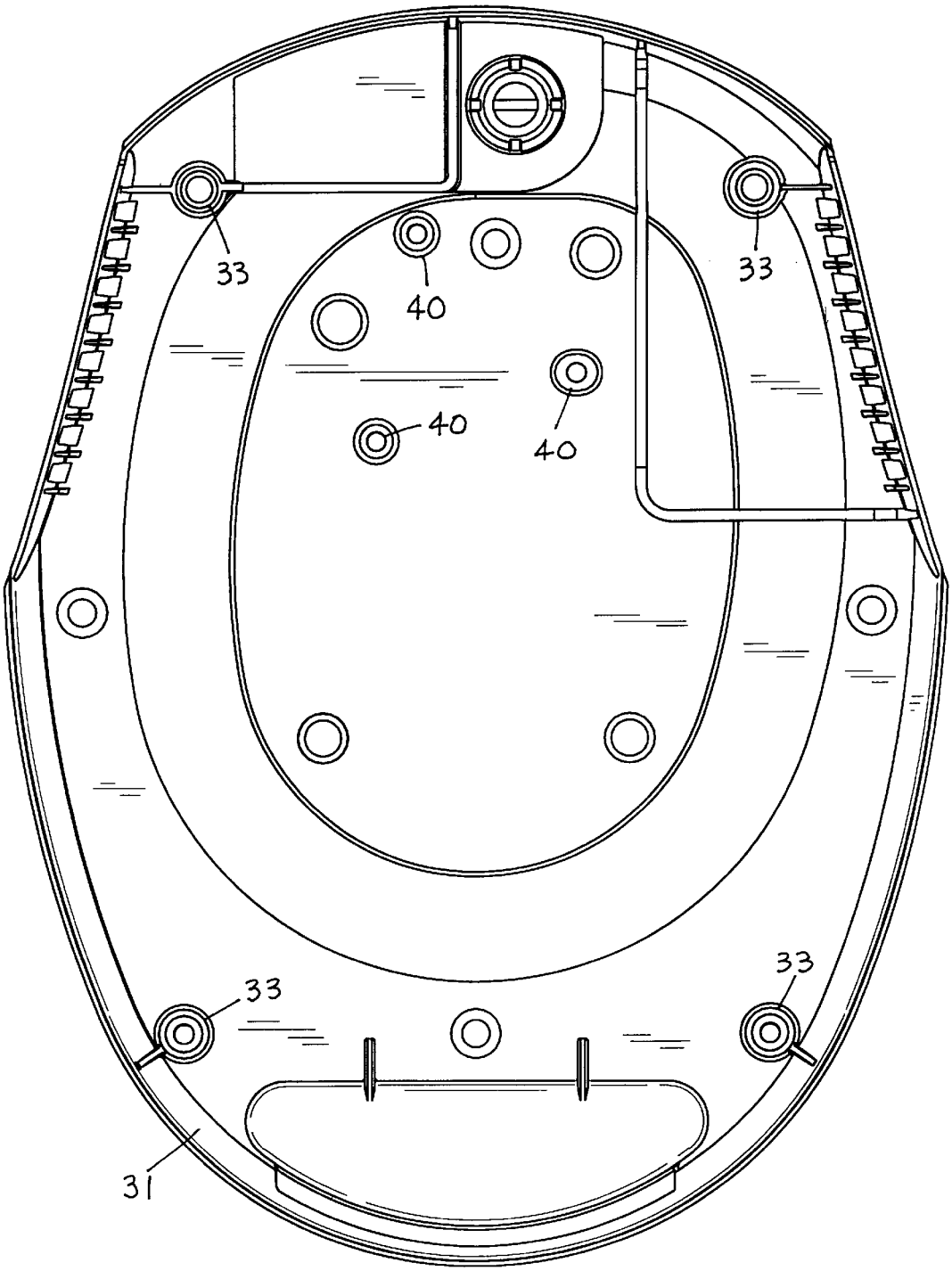
FIGS. 9 and 10 are plan views of the inside surface of two housing halves that enclose the compressor.
Figure 10:
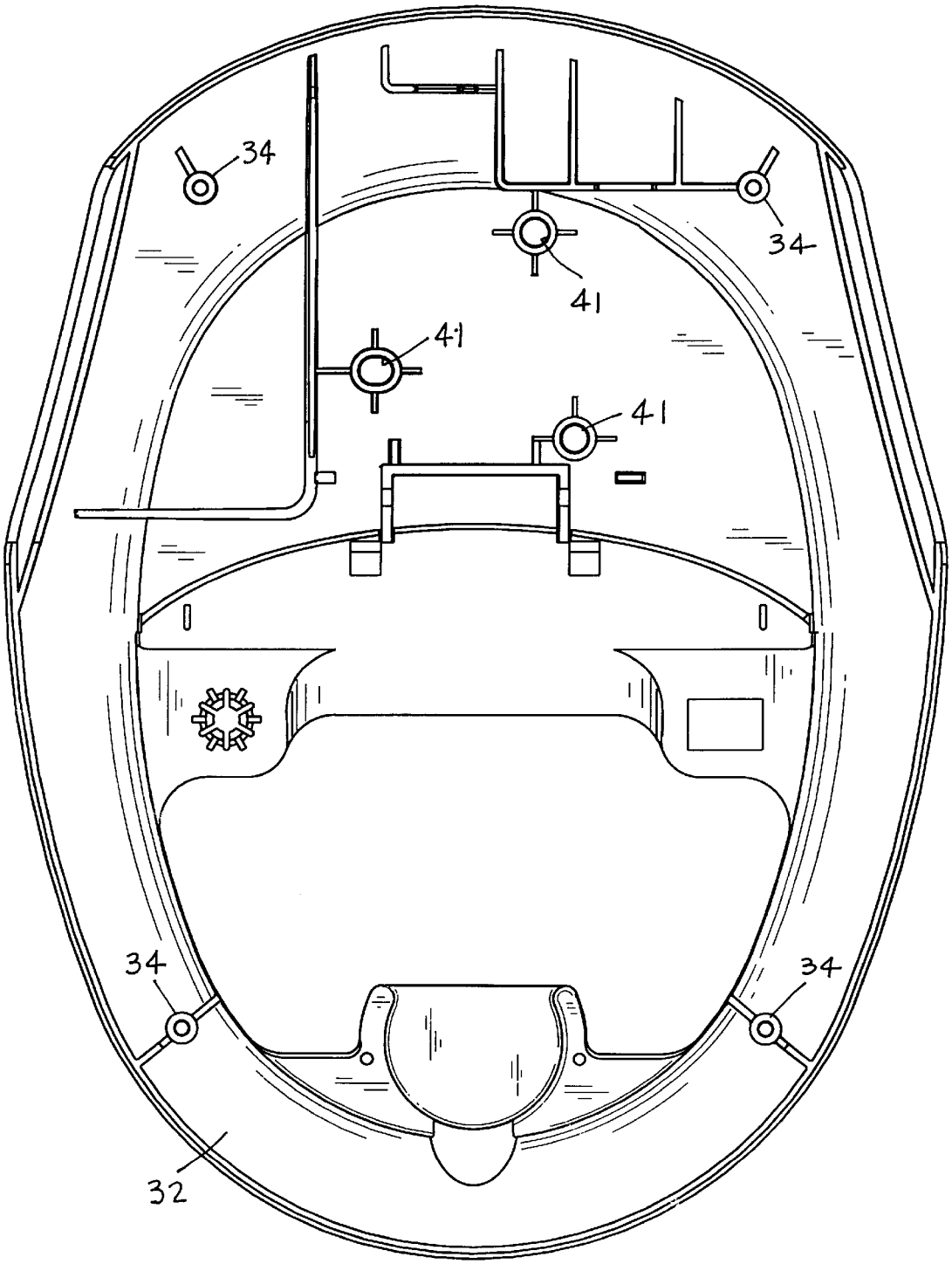

The mounting portions 36 have cylindrical extensions that project in both directions from the plane of the arms 37, as shown in FIG. 6. As shown in FIG. 7, the extensions of the mounting portions 36 on both sides of the arms 37 may be hollow. A pattern of four equally spaced ears 38 project from each end of a mounting portion 36 and the ears 38 on one side of the plane of the arms 37 are off-set from the ears 38 on the other side of the plane of the arms 37 as shown in FIG. 6.

The three-point mounting member 35 is formed from an injection-moldable thermoplastic elastomer, or other natural or synthetic elastomeric material. If the material is sufficiently compressible, the mounting portions 36 may be solid rather than hollow.

The mounting portions 36 of the three-point mounting member 35 are received in three hollow sleeve-like bosses 40 formed in a triangular pattern in the one housing half 31. A second three-point mounting member 35 is received in similar bosses 41 formed in the second housing half 32. The housing halves can take many forms and the form shown is merely exemplary. The mounting members may have two mounting portions instead of three and may have more than three. Three mounting portions facilitate ease of assembly.

The front bracket 12 has laterally projecting sleeves 45 and 46 extending from each side. The rear bracket 13 has pairs of laterally projecting sleeves 47, 48 and 49, 50 extending from each side. The sleeves on each side are arranged in an equilateral triangle to match the bosses in the housing halves. The sleeves 45 through 50 receive the opposite projecting extensions of the mounting portions of the three-point mounting members 35.

The mounting elements 35 provide the only connection of the compressor to the housing. Noise and vibrations caused by the reciprocating piston are isolated from the housing halves 31 and 32.

I claim:

1. A pumping apparatus, comprising:

a motor and cylinder assembly including an electric motor, a cylinder having inlet and outlet valves, and a reciprocating piston driven by the motor and operating in the cylinder, said assembly having three spaced mounting points on each side of the assembly;

a pair of housing halves adapted to be joined together to enclose the assembly;

the housing halves each having three spaced bosses adapted to be aligned with the mounting points on a respective side of the assembly; and a pair of resilient mounting elements to isolate the assembly from the housing, the mounting elements each including three mounting portions that are engaged by the mounting points and the bosses, and arms connecting the mounting portions.

2. A pumping apparatus in accordance with claim 1 wherein the mounting elements are formed of an elastomer.

3. A pumping apparatus in accordance with claim 2 wherein the mounting points and bosses are each formed as hollow sleeves, and the mounting portions include cylindrical extensions that are received in the hollow points and bosses.

4. A pumping apparatus in accordance with claim 3 wherein the cylindrical extensions project in both directions from a plane defined by the arms, and the cylindrical extensions are hollow.

5. A pumping apparatus in accordance with claim 4 wherein a series of integral projections surround each extension and are adapted to engage end surfaces of the mounting points and bosses.

6. A pumping apparatus in accordance with claim 5 wherein the projections on one side of the plane of the arms are offset from those on the other side of the plane.

7. A pumping apparatus in accordance with claim 1 wherein the mounting portions are disposed at the corners of an equilateral triangle.

8. In a pumping apparatus including a motor and reciprocating piston assembly enclosed in a housing formed of separable housing halves joined together, the improvement comprising:

a plurality of spaced hollow cylindrical mounting points extending outwardly from opposite sides of the assembly;

a like plurality of hollow cylindrical bosses extending inwardly from each housing half with the bosses alignable with the mounting points on a respective side of the assembly; and resilient mounting members received in the aligned mounting points and bosses.

9. A pumping apparatus in accordance with claim 8 wherein the mounting members are formed of an elastomer and integral arms join the mounting members together.

* * * * *